US005692406A

United States Patent [19]

Yasui

[11] Patent Number: 5,692,406

[45] Date of Patent: Dec. 2, 1997

[54] GAS INLET FOR A SUPERPLASTIC FORMING DIE AND METHOD OF USE

[75] Inventor: Ken K. Yasui, Huntington Beach, Calif.

[73] Assignee: McDonnell Douglas Corporation, Huntington Beach, Calif.

[21] Appl. No.: 721,483

[22] Filed: Sep. 27, 1996

[51] Int. Cl.[6] ..... B21D 26/02

[52] U.S. Cl. ..... 72/60; 72/709; 29/421.1

[58] Field of Search ..... 72/60, 61, 709, 72/342.7, 364; 29/421.1

[56] References Cited

U.S. PATENT DOCUMENTS

| | | | |
|---|---|---|---|
| 2,998,622 | 9/1961 | Renoux | 72/60 |
| 3,934,441 | 1/1976 | Hamilton et al. | 72/60 |
| 4,331,284 | 5/1982 | Schulz et al. | 228/157 |
| 4,420,958 | 12/1983 | Shultz et al. | 72/60 |
| 4,534,196 | 8/1985 | Kiyota | 72/61 |

*Primary Examiner*—David Jones

*Attorney, Agent, or Firm*—Bell, Seltzer, Park & Gibson, P.A.

[57] ABSTRACT

An improved die for a superplastic formation process and the process that uses an interface for pressurized gas that is part of the forming die so that tube welding to the forming pack can be eliminated. In one embodiment, the interface is fixed to the die and in a second, for use to pressurize the interior volume of finished parts with inert gas when the finished parts are to be removed from the die hot (1400° F.), the interface becomes welded to the pack during the forming process so that the interior of the part can be flooded with inert gas during the cool down process.

20 Claims, 2 Drawing Sheets

GAS INLET FOR A SUPERPLASTIC FORMING DIE AND METHOD OF USE

FIELD OF THE INVENTION

This invention relates to the field of metal forming and, more particularly, to the forming and diffusion bonding of metals that exhibit superplastic characteristics in a die that includes one or more gas-to-forming pack interfaces so that no tubes need to be welded to a forming pack prior to its insertion into the forming die for forming.

BACKGROUND OF THE INVENTION

Superplasticity is the characteristic demonstrated by certain metals which exhibit extremely high plasticity. They develop high tensile elongations with minimum necking when deformed within specific temperature ranges and limited strain rate ranges. The methods used to form and in some cases diffusion bond superplastic materials capitalize on these characteristics and typically employ gas pressure to form sheet material into or against a configurational die in order to form a part. Diffusion bonding is frequently associated with the process. U.S. Pat. No. 3,340,101 to D. S. Fields, Jr. et al.; U.S. Pat. No. 4,117,970 to Hamilton et al.; U.S. Pat. No. 4,233,829 to Hamilton et al.; and U.S. Pat. No. 4,217,397 to Hayase et al. are all basic patents, with various degrees of complexity, relating to superplastic forming where at some point, pressurized inert gas is used to form the material and to at least assist in the diffusion bonding process.

Heretofore, when using superplastic forming/diffusion bonding (SPF/DB) processes to produce integrally stiffened panel structures from flat multisheet forming packs, one or more gas inlet tubes had to be welded onto each pack before it was loaded into the forming die. This is a complex, time-consuming operation, and the protruding inlet tube is easily damaged during fabrication and loading.

A gas inlet formed in a die is shown in U.S. Pat. No. 5,069,383 by Cooper et al. but it is useful only in special circumstances and occasionally fails to provide a seal. Another gas inlet formed in a die is shown in U.S. Pat. No. 4,331,284 by Schultz et al. but it depends on a surrounding die ring and die force to maintain the seal. As pressure increases, the Schultz seal structure is more likely to leak.

SUMMARY OF THE INVENTION

In the present invention, a gas inlet system is incorporated into the forming dies for SPF/DB processes to eliminate damage-induced inlet tube failure and to reduce processing time. The gas inlets normally are part of the die and are not attached to the forming pack when the finished panels are going to be removed from the die after a cooling off period, during which time the temperature of the die and the formed part is reduced below 900° F. so that the formed part can be removed without deformation and/or internal oxidation thereof.

The present gas inlet system includes a gas inlet tube that is connected to the forming die. The forming die has a gas passage from the inlet tube to the die surface. A center protrusion positioned about the inlet tube as it extends through the die surface mates with an inlet hole in the forming pack surrounded by a sealing ring in an area that will be trimmed away once the part is formed. The die surface includes a gas sealing depression about the protrusion, which with the assistance of the sealing ring, forms a gas tight seal with the forming pack when the die is pressed against the forming pack. The seal remains gas tight until the formed part is removed from the die. The present invention also can be used to provide exhaust tubes to the forming pack.

It is desirable to unload the formed parts from the forming die hot (over 1400° F. for some alloys). Hot unloading improves part properties, lengthens die life, and shortens processing time. However, when the temperature of a titanium part (Ti-6Al-4V), such as are commonly made with SPF/DB processes, exceeds 900° F., the internal surface of the part is subject to oxidation embrittlement. To preclude oxidation, inert gas, such as argon, must be maintained in the interior cavity of the part. The part also must be pressurized to prevent it from collapsing due to the reduction of internal gas volume during sudden cool down. The embodiment of the invention described above does not allow pressurized argon gas to be maintained in a formed part once it is out of the forming die, hence the following modified embodiment is desirable.

The basic design of the modified gas inlet system is identical to the gas inlet system described above. However, in the modified system, the center protrusion of the gas passage is constructed from titanium or other diffusion bondable material, is removable from the die, and includes a gas feeding line that extends out of the die in a groove formed for that purpose. The inlet tube and center protrusion are formed as a separate assembly that is restrained in a mating depression and groove in the die until the part is removed from the die. During fabrication and loading, the forming pack has no gas inlet tube attached. However, during the superplastic forming process, the center protrusion diffusion bonds to the forming pack and becomes permanently attached thereto. The inlet tube then can be used for feeding pressurized argon gas into the interior cavity of the formed part to prevent internal oxidation and keep the part from collapsing during cool down. The first embodiment of the invention may be combined in a die with the second to provide face sheet inlet and exhaust ports where essentially no interior volume remains connected thereto after the part is formed. Oxidation normally occurs on the exterior of a formed part during the forming process whether the formed part is removed from the die above 900° F. or not. The exterior oxidation is usually removed with a standard chemical milling process.

It therefore is an object of the present invention to reduce the time required to form a part with SPF/DB processes.

Another object of this invention to eliminate the need for separate tube welding operations during an SPF/DB process.

Another object of this invention to provide a perfect seal that get more secure with increasing pressure for use in an SPF/DB process.

Another object is to provide means that allow a part to be removed hot from an SPF/DB die.

These and other objects and advantages of the present invention will become apparent to those skilled in the art after considering the following detailed specification, together with the accompanying drawings wherein:

DETAILED DESCRIPTION OF THE PREFERRED EMBODIMENTS

Figure 1:
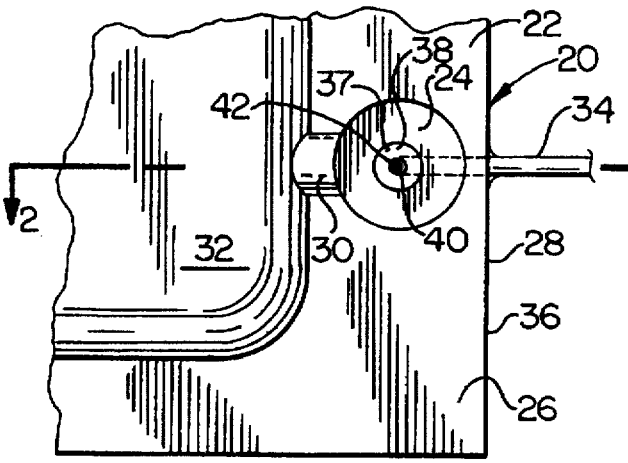
FIG. 1 is a partial top view of a die with the present invention incorporated therein.
Figure 2:
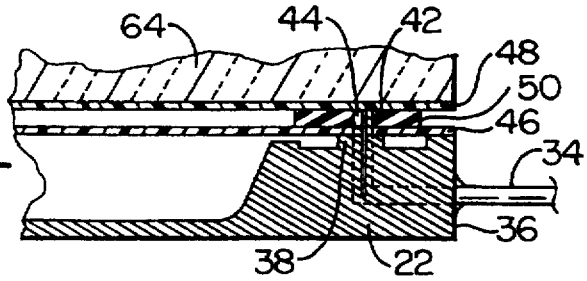
FIG. 2 is a cross-sectional view taken at line 2—2 in FIG. 1.

Referring to the drawings more particularly by reference numbers, number 20 in FIG. 1 refers to a gas inlet system for a die 22. The gas inlet system 20 includes at least one ring shaped depression 24 formed in a die mating surface 26 at the edge 28 of the die 22. A galley 30 extends from the ring depression 24 into the main forming cavity 32 of the die 22. A gas passage 34 extends through the side 36 of the die 22 and up through the radial sealing surface 37 of a seal protrusion 38 in the center 40 of the ring depression 24. A centering pin 42 extends out of the gas passage 34 at the seal protrusion 38 so that a hole 44 in the lower of two sheets 46 and 48 to be formed (FIG. 2) can be kept in alignment therewith.

Figure 3A:
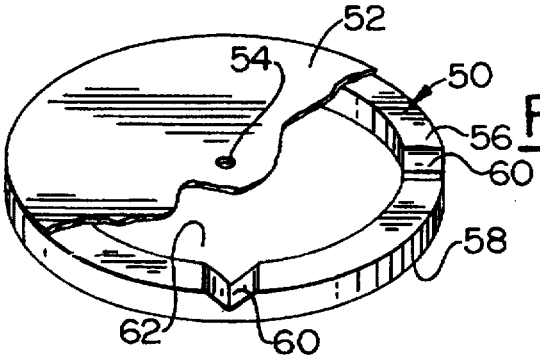
FIG. 3A is an enlarged perspective view of the sealing ring of FIG. 2.
Figure 3B:
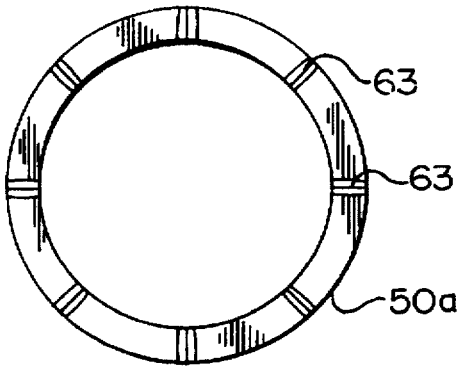
FIG. 3B is an enlarged top view of an economical sealing ring that can be substituted for the ring of FIG. 3A.
Figure 4:
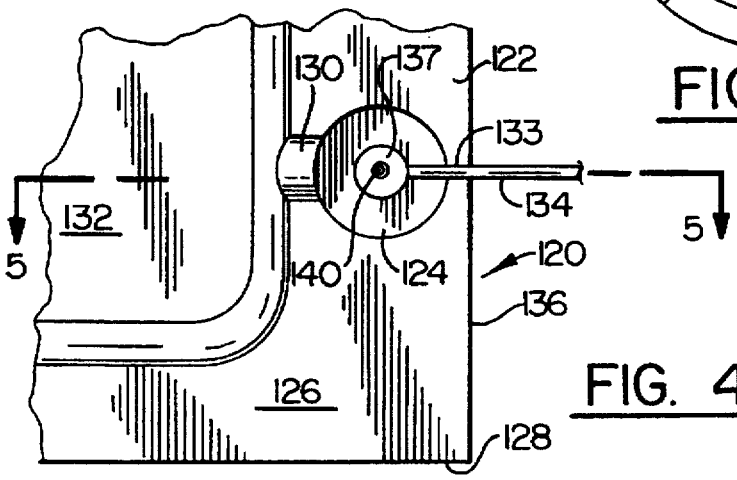
FIG. 4 is a partial top view of a die with a modified embodiment of the present invention incorporated therein.
Figure 5:
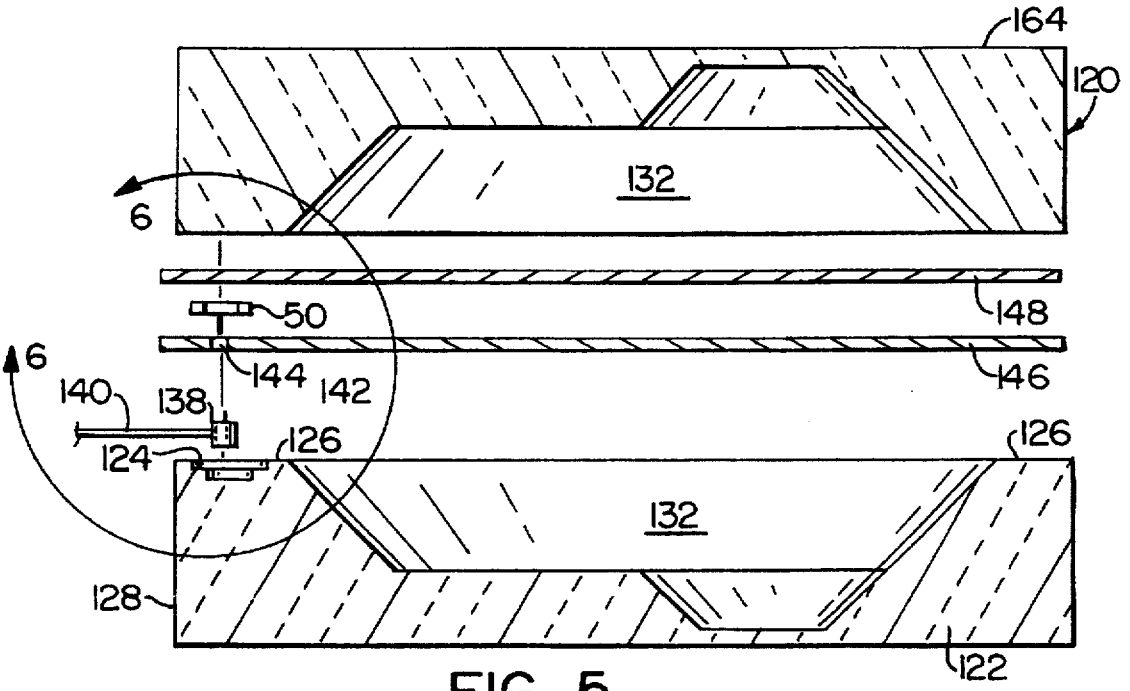
FIG. 5 is an enlarged exploded cross-sectional view taken at line 5—5 of the die of FIG. 4.
Figure 6:
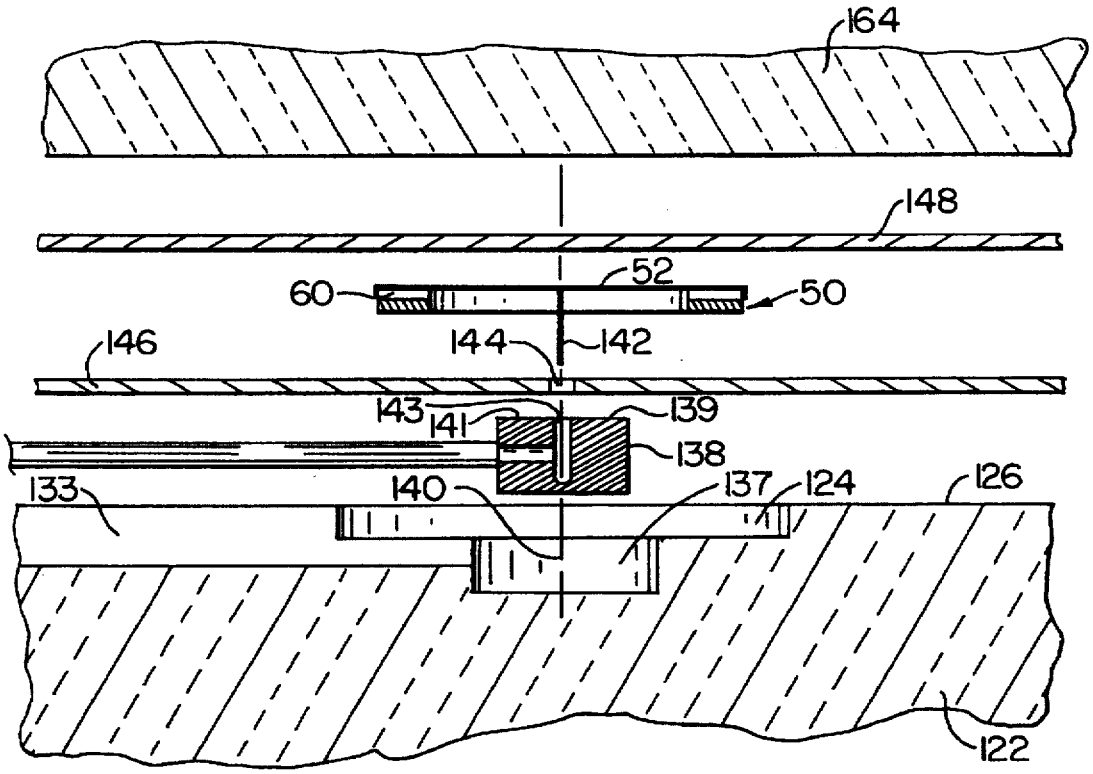
FIG. 6 is an enlarged detail view of the area 6—6 of FIG. 5.

A seal ring 50, as shown in FIG. 3A, is placed between the two sheets 46 and 48 about the hole 44 and is aligned with the ring depression 24 by the pin 42 and a centering cover 52 having a central hole 54 for engagement about the pin 42. The seal ring 50 includes upper and lower sealing surfaces 56 and 58 and one or more gas passages 60 radially there through to communicate its center 62 and the gas passage 34 with a passageway between the sheets 46 and 48 that forms through the galley 30 during the forming process. A more economic version **50*a* of the ring 50 is shown in FIG. 3B, wherein a titanium ring 50*a* has gas passages 63 formed therein by merely cutting the ring 50*a* partially with a pare of wire cutters at spaced locations there around. An upper die 64 is pressed down onto the sheets 46 and 48, and the ring 50 to form a seal about the mating surface 26 as the whole assembly is heated to superplastic forming temperatures. Pressurized gas is then fed through the gas passages 34 and 60 to expand the sheets 46 and 48 into the shape of the forming cavity 32. Once the part has formed, the assembly is cooled and the part, ready for trimming and surface finishing, is removed from the dies 22 and 64. If the tolerances are correct and the dies are not constructed from ceramic material (ceramic dies have poor gas sealing characteristics), the dies 22 and 64 can be used to form a single sheet 46, with the ring 50 providing gas passages to above the galley 30 so that the sheet 46 deforms into the galley 30 to form a gas passage above the sheet 46 and the forming cavity 30 and below the die 64**.

It is desirable to unload formed parts from the forming die hot (over 1400° F. for some alloys). Hot unloading improves part properties, lengthens die life, and shortens processing time. However, when the temperature of a titanium part exceeds 900° F., the internal surface of the part is subject to oxidation embrittlement. To preclude oxidation, inert gas must be introduced into the interior cavity of the part. The interior of the part also must be pressurized to prevent the part from collapsing due to the reduction of internal gas volume during sudden cool down. The system 20 described above does not allow inert gas to be used to pressurize the formed part once it is out of the dies 22 and 64. Therefore, when the part is to be removed hot, the following modified system 120 is used to provide a continuing inert gas connection to the interior volume(s) of the part.

The gas inlet system 120 for a die 122 includes a ring shaped depression 124 formed in a mating surface 126 at the edge 128 of the die 122. A galley 130 extends from the ring depression 124 into the main forming cavity 132 of the die 122. A groove 133 for a gas passage tube 134 extends from the side 136 of the die 122 to a depression 137 for a seal member 138 in the center 140 of the ring depression 124. The seal member 138 fits within the depression 137 extending upwardly so that its upper radial surface 141 ends up located just like the radial sealing surface 37 of the seal protrusion 38. The gas passage tube 134 is attached thereto and fits within the groove 133. A centering pin 142 extends out of the gas passage 143 formed by the tube 134 and the seal member 138 so that a hole 144 in the lower of two sheets 146 and 148 to be formed can be kept in alignment therewith. The seal member 138 is made from a diffusion bondable material such as titanium.

A seal ring 50, as shown in FIG. 3, is placed between the two sheets 146 and 148 about the hole 144 and is aligned with the ring depression 124 by the pin 142 and the central hole 53 of the centering cover 52. The seal ring 50 acts as before to assist in the formation of a gas seal and to provide gas passageways between the sheets 146 and 148. An upper die 164 is pressed down onto the sheets 146 and 148, and the ring 50 to form a seal about the mating surface 126 as the whole assembly is heated to superplastic forming temperatures. Pressurized gas is then fed between the sheets 146 and 148 to expand them into the shape of the forming cavity 132. At the same time the seal member 138 is diffusion bonded to sheet 146.

Once the part has been formed from the sheets 146 and 148, the forming pressure is reduced to a point were the part does not collapse nor further expand, and the part is removed from the dies 122 and 164. The part is then cooled out of the dies 122 and 164 so the dies 122 and 164 can be used to form the next part. The pressurized inert gas in the part prevents internal oxidation. Not only does the system 120 allow the die members 122 and 164 to be used to build more parts during a shift, the energy cost per part is greatly reduced because only the forming pack, which has relatively little heat capacity with respect to what are normally massive dies, need be heated up to superplastic forming temperature. The system 120 requires at least two sheets 146 and 148 and does not rely on any part of the dies 122 or 164 to form sealing surfaces. Therefore the dies 122 and 164 can be made from ceramic material, which has a superior working lifetime, but poor gas sealing properties. In a four sheet Hayase part, both systems 20 and 120 may be employed, system 20 for face sheet forming and exhaust, and system 120 for web forming, since after a Hayase part has formed, the interior thereof is only the volume between the web forming sheets.

Thus, there has been shown novel SPF/DB forming systems and methods which fulfill all of the objects and advantages sought therefor. Many changes, alterations, modifications and other uses and applications of the subject invention will become apparent to those skilled in the art after considering the specification together with the accompanying drawings. All such changes, alterations and modifications which do not depart from the spirit and scope of the invention are deemed to be covered by the invention which is limited only by the claims that follow.

I claim:

1. A method for applying pressurized inert gas in a superplastic forming process including:

providing a pair of dies with: a forming cavity in at least one of the dies, mating edge surfaces, at least one of the edge surfaces having a sealing ring depression therein which has a gas passage extending therein from outside the die, and a galley that extends from the sealing ring depression to the forming cavity;

loading at least one sheet of superplastically formable material between the mating edge surfaces, the at least one sheet having a hole there through that is placed in gas communication with the gas passage;

placing a sealing ring having at least one gas passage formed there through about the hole opposite the sealing ring;

forcing the mating edges toward each other to seal the at least one sheet against the dies;

heating the die to superplastic forming temperature;

pressurizing the gas passage to form the at least one sheet into the forming cavity; and removing the formed part from the forming cavity.

2. The method as defined in claim 1 including:

aligning the hole in the sheet with the gas passage by: placing an alignment pin in the gas passage and the hole.

3. The method as defined in claim 2 wherein the pressurizing of the gas passage to form the at least one sheet into the forming cavity is accomplished with inert gas, the method further including:

cooling the part below superplastic forming temperature before removing the pressurized inert gas from the part and removing the part from the forming cavity.

4. The method as defined in claim 1 wherein the loading includes loading at least two sheets, the sealing ring being placed between the at least two sheets.

5. The method as defined in claim 4 including:

providing a seal depression in the at least on die central to the ring depression and a tube galley from the seal depression to the edge of the at least one die;

providing a seal member with a gas passage tube in the seal depression and the tube galley, the seal member having a surface in contact with the at least one sheet and being of a material that can be diffusion bonded therewith; and diffusion bonding the seal member surface to one of the sheets as at least one sheet is formed into the forming cavity.

6. The method as defined in claim 5 wherein the part is removed from the forming cavity while still at superplastic forming temperature.

7. The method as defined in claim 5 wherein the part is removed from the forming cavity while still at superplastic forming temperature, including:

depressurizing the gas passage to a pressure above atmospheric pressure before removing the formed part from the forming cavity.

8. A superplastic forming die assembly including:

a first sheet to be formed having a first gas passage formed there through;

a first die member having:

an edge;

a gas connector extending from said edge;

an edge surface extending inwardly from said edge;

a seal depression in said edge surface;

a seal protrusion in said seal depression;

a forming cavity; and a second gas passage extending from said seal protrusion to said gas connector;

a second die member having:

an edge;

an edge surface extending inwardly from said edge of said second die member, said edge surfaces mating; and a sealing member shaped to loosely nest in said seal depression with said first sheet to be formed between said seal depression and said sealing member, and said seal protrusion located therein, said sealing member including:

at least one third gas passage there through to communicate pressurized gas from said gas connector through said first and second gas passages for forming said first sheet into said forming cavity.

9. The superplastic forming die assembly as defined in claim 8 wherein at least one of said edge surfaces includes:

a gas galley extending from said seal depression to said forming cavity.

10. The superplastic forming die assembly as defined in claim 8 wherein said sealing depression and said sealing member are ring shaped, said at least one third gas passage being formed generally radially through said ring shaped sealing member.

11. The superplastic forming die assembly as defined in claim 8 wherein one of said die members further includes:

a second seal depression;

a second gas connector;

a second seal protrusion;

a second passageway from said edge in said edge surface thereof to said second seal depression, and wherein said second seal protrusion is a protrusion member that nests in said second seal depression and is constructed from diffusion bondable material, said second gas connector being:

a gas tube connected to said protrusion member that rests in said second passageway when said protrusion member is nested in said second seal depression.

12. The superplastic forming die assembly as defined in claim 8 wherein said first die member further includes:

a passageway from said edge in said edge surface thereof to said seal depression, and wherein said seal protrusion is a protrusion member that nests in said seal depression and is constructed from diffusion bondable material, said gas connector being:

a gas tube connected to said protrusion member that rests in said passageway when said protrusion member is nested in said seal depression.

13. The superplastic forming die assembly as defined in claim 8 further including:

a centering pin in said second gas passage that extends into said first gas passage to align said first and second gas passages.

14. The superplastic forming die assembly as defined in claim 13 wherein said protrusion member includes:

a bonding surface positioned to contact said first sheet for diffusion bonding thereto.

15. A superplastic forming die assembly including:

a first die member having:

an edge;

a gas connector extending from said edge;

an edge surface extending inwardly from said edge;

a seal depression in said edge surface;

a seal protrusion in said seal depression; and a first gas passage extending from said seal protrusion to said gas connector;

a second die member having:

an edge;

an edge surface extending inwardly from said edge of said second die member, said edge surfaces mating; and a sealing member shaped to loosely nest in said seal depression with a sheet to be formed between said seal depression and said sealing member, and said seal protrusion located therein, said sealing member including:

at least one second gas passage there through to communicate pressurized gas from said gas connector through said first gas passage for forming the sheet.

16. The superplastic forming die assembly as defined in claim 15 wherein said edge surfaces are planar surfaces.

17. The superplastic forming die assembly as defined in claim 15 wherein said sealing depression and said sealing member are ring shaped, said at least one second gas passage being formed generally radially through said ring shaped sealing member.

18. The superplastic forming die assembly as defined in claim 15 wherein said first die member further includes:

a passageway from said edge in said edge surface thereof to said seal depression, and wherein said seal protrusion is a protrusion member that nests in said seal depression and is constructed from diffusion bondable material, said gas connector being:

a gas tube connected to said protrusion member that rests in said passageway when said protrusion member is nested in said seal depression.

19. The superplastic forming die assembly as defined in claim 15 wherein said first and second die members are ceramic die members.

20. The superplastic forming die assembly as defined in claim 15 wherein said first die member further includes:

a forming cavity; and a galley extending between said forming cavity and said seal depression.

* * * * *